US012655547B2

(12) United States Patent
Budd

(10) Patent No.: US 12,655,547 B2
(45) Date of Patent: Jun. 16, 2026

(54) ALPACA FIBER COMPOSITE YARN

(71) Applicant: James Patrick Budd, Bozeman, MT (US)

(72) Inventor: James Patrick Budd, Bozeman, MT (US)

( * ) Notice: Subject to any disclaimer, the term of this patent is extended or adjusted under 35 U.S.C. 154(b) by 0 days.

(21) Appl. No.: 19/013,719

(22) Filed: Jan. 8, 2025

(65) Prior Publication Data

US 2025/0250722 A1 Aug. 7, 2025

Related U.S. Application Data

(63) Continuation of application No. 17/825,832, filed on May 26, 2022, now abandoned.

(60) Provisional application No. 63/193,488, filed on May 26, 2021.

(51) Int. Cl.

| | |
|---|---|
| ***D02G 3/38*** | (2006.01) |
| ***D02G 3/02*** | (2006.01) |
| ***D02G 3/36*** | (2006.01) |

(52) U.S. Cl.

CPC ..... *D02G 3/38* (2013.01); *D02G 3/025* (2013.01); *D02G 3/36* (2013.01)

(58) Field of Classification Search

CPC ..... D02G 3/025; D02G 3/36; D02G 3/38
See application file for complete search history.

(56) References Cited

U.S. PATENT DOCUMENTS

| | | | | |
|---|---|---|---|---|
| 1,412,446 | A | | 4/1922 | Bentley |
| 1,987,632 | A | | 1/1935 | Nutter et al. |
| 3,387,450 | A | | 6/1968 | Desmond |
| 5,572,860 | A | * | 11/1996 | Mitsumoto ..... D04B 1/106 57/224 |
| 6,330,786 | B1 | | 12/2001 | Settle |
| 6,658,835 | B1 | | 12/2003 | Bowers |
| 7,866,137 | B2 | | 1/2011 | Kline et al. |
| 7,886,514 | B2 | | 2/2011 | Hegan, Jr. |
| 10,500,102 | B2 | | 12/2019 | Duda |
| 10,597,798 | B1 | | 3/2020 | Su et al. |
| 2007/0160653 | A1 | | 7/2007 | Fischer et al. |
| 2009/0220784 | A1 | | 9/2009 | Blitstein et al. |
| 2010/0162677 | A1 | | 7/2010 | Qiu et al. |
| 2012/0102632 | A1 | | 5/2012 | Zhu |
| 2015/0329997 | A1 | | 11/2015 | Switzer et al. |
| 2020/0080239 | A1 | | 3/2020 | Kestner et al. |
| 2021/0047757 | A1 | | 2/2021 | Cleveland et al. |
| 2021/0148013 | A1 | | 5/2021 | Baranek et al. |

(Continued)

FOREIGN PATENT DOCUMENTS

| | | | |
|---|---|---|---|
| CN | 101377030 | A | 3/2009 |
| CN | 106939465 | A | 7/2017 |
| CN | 106948063 | A | 7/2017 |

(Continued)

OTHER PUBLICATIONS

Machine Translation of CN 113622063 A, retrieved Mar. 2023 (Year: 2023).

(Continued)

*Primary Examiner* — Shaun R Hurley
(74) *Attorney, Agent, or Firm* — Merchant & Gould, P.C.

(57) ABSTRACT

This disclosure relates generally to a composite yarn comprising a core and an outer wrapping. The core comprises an alpaca fiber roving. The outer wrapping comprises a second fiber.

16 Claims, 4 Drawing Sheets

(56) References Cited

U.S. PATENT DOCUMENTS

2023/0383444 A1* 11/2023 Budd ..... D02G 3/38

FOREIGN PATENT DOCUMENTS

| | | | |
|---|---|---|---|
| CN | 107099913 | A | 8/2017 |
| CN | 107503012 | A | 12/2017 |
| CN | 109440243 | A | 3/2019 |
| CN | 211251617 | U | 8/2020 |
| CN | 113622063 | A | 11/2021 |
| WO | 2009/098585 | A2 | 10/2009 |
| WO | 2010/051074 | A1 | 5/2010 |
| WO | 2018/205306 | A1 | 11/2018 |

OTHER PUBLICATIONS

Wang, et al., "The Quality and Processing Performance of Alpaca Fibres", Australian Government—Rural Industries Research and Development Corporation, Nov. 2023; RIRDC Publication No. 03/128; RIRDC Project No. UD-2A; 132 pgs.

* cited by examiner

ALPACA FIBER COMPOSITE YARN

CROSS-REFERENCE TO RELATED APPLICATION(S)

This application is a continuation application of U.S. patent application Ser. No. 17/825,832, filed May 26, 2022, which claims the benefit of U.S. Provisional Patent Application Ser. No. 63/193,488, filed May 26, 2021, the entire disclosures of each of which are hereby incorporated by reference in their entireties.

TECHNICAL FIELD

This disclosure relates to composite yarns and methods of making. More particularly, the composite yarns include alpaca fibers.

BACKGROUND

Alpacas have a natural coat that can be sheared for use in textiles. Alpaca fibers are high-grade raw materials used for a variety of textiles. Like sheep's wool, alpaca wool can be used on its own or in combination with other fibers to create the desired textile.

Traditional wools, such as sheep's wool, need to be treated with chemicals and/or utilize ecologically harmful practices during processing.

SUMMARY

In general terms, this disclosure is directed towards composite yarn including an alpaca fiber core.

In a first aspect, the disclosure relates to a composite yarn comprising a core and an outer wrapping. The core comprises an alpaca fiber roving. The outer wrapping comprises a second fiber. In an embodiment, the core consists of alpaca fiber roving, while in another embodiment, the core comprises alpaca fiber roving in combination with a second, different fiber type. In an embodiment, the second fiber may be alpaca fiber, a different fiber, or a combination thereof.

In a second aspect, the disclosure relates to a method of making a composite yarn comprising a core and an outer wrapping. The core comprises an alpaca fiber roving. The outer wrapping comprises a second fiber. In an embodiment, the core consists of alpaca fiber roving, while in another embodiment, the core comprises alpaca fiber roving in combination with a second, different fiber type. In an embodiment, the second fiber may be alpaca fiber, a different fiber, or a combination thereof.

Corresponding reference characters indicate corresponding parts throughout the several views. The exemplifications set out herein illustrate at least one embodiment of the invention, and such exemplifications are not to be construed as limiting the scope of the invention(s) in any manner.

BRIEF DESCRIPTION OF THE DRAWINGS

The present disclosure will be described hereafter with reference to the attached drawings which are given as non-limiting examples only, in which.

DETAILED DESCRIPTION

Figure 1:
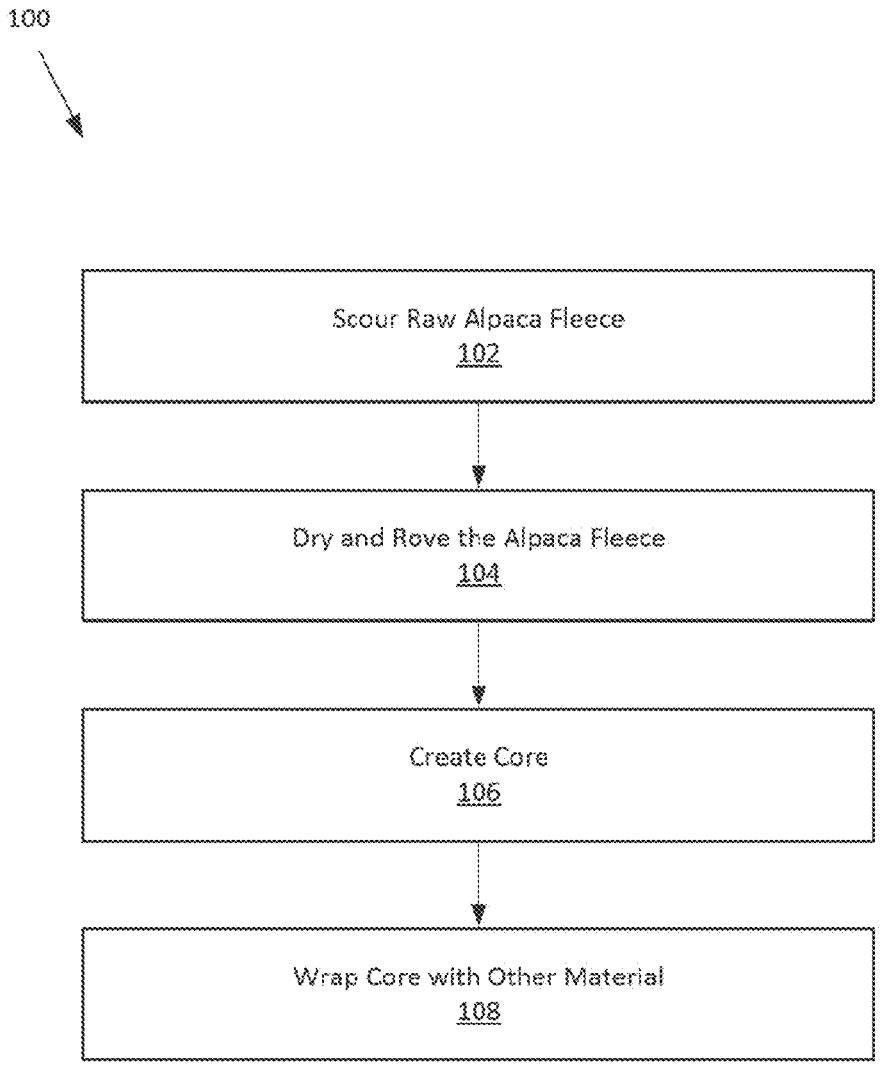
FIG. 1 illustrates an example method of making a composite yarn.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments, whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

This disclosure relates to composite yarns and methods of making composite yarns. The composite yarns described herein comprise an alpaca fiber core and a second fiber that forms an outer coating around the core. The core may consist of alpaca fiber, and in an alternative embodiment, the core may include the alpaca fiber and a second fiber. Likewise, the outer wrapping may include a fiber that is alpaca fiber, a different type of fiber, or a combination thereof.

Alpaca coat raw material can be processed to create alpaca fibers and then into yarns. Alpaca fibers have natural qualities such as being non-pilling, water-repellant, breathable, strong, durable, and non-fraying, while having great heat-retention qualities.

According to one example embodiment, the inventive yarn has passed the CFR 1610 Textile Test as well as the Vertical Flammability ASTM D6413 Test without any added chemicals or other additives.

These characteristics make alpaca fibers desirable for creating textiles. Further, alpaca fibers, when spun tightly, possess anti-microbial and anti-bacterial properties.

The composite yarns described herein are useful for making fabrics. The yarns discussed here generally have, at least, a core fiber and an outer fiber that surrounds the core. The composite yarns described herein include an alpaca core fiber. In some embodiments, the alpaca core fiber is the only core fiber. In other embodiments, the alpaca fiber is spun with another fiber to create the core. The inventive yarn includes the alpaca fiber core and a different fiber twisted around the core.

Alpaca fibers are unique in that the fiber itself is essentially hollow and has barbs on an exterior surface that curl towards a longitudinal center of the fiber. The fiber wall diameter is sturdy, which gives the alpaca fiber strength. The fiber itself is essentially hollow.

Alpaca wool is used to make the composite yarn as described herein. Alpaca wool is naturally waterproof as it naturally wicks away moisture, which makes it a desirable yarn for garments, such as socks and outerwear, or for textiles in other industries such as medical textiles. Alpaca wool is generally also softer than cashmere, which makes it a desirable yarn for garments, as well as blankets and other similar items.

Described herein is a composite yarn comprising at least a yarn core and an outer surface of the yarn. The yarn core is made from alpaca fibers, while the outer surface may also be made from alpaca fibers, other types of fibers, or a combination of alpaca fibers and other types of fibers. Other types of fibers include both natural and synthetic fibers.

Types of natural fibers include those from animals such as goat, sheep, mink, beaver, ermine, fox, nutria, opossum, sable, seal, muskrat, raccoon, squirrel, camel, and llama. Types of natural fibers may also include tree bark, eucalyptus tree bark, and bamboo. Types of synthetic fibers include, but are not limited to, polymers such as spandex and nylon.

In an embodiment, the yarn core is made from alpaca fibers that are twisted around together. In an embodiment where the core comprises other fibers, the other fibers are blended with the alpaca yarn and twisted together to create the core. In another embodiment, the yarn core is made from alpaca fibers mated with another fiber. Twisting the alpaca yarn core may increase the amount of surface area on the fiber itself. The increased surface area created on the alpaca core prevents bacteria from pooling. Therefore, it is desirable to have an alpaca yarn core that is twisted to create as much surface area as possible. The number of twists of the alpaca yarn core depends on the end-use of the yarn and textile. For example, garments such as socks may require more twists than blankets.

After the alpaca fibers and/or another fiber are twisted to form the yarn core, an additional fiber is wrapped around the core to form the outer coating. As described above, the additional fiber may be alpaca fibers, other natural fibers, or other synthetic fibers. The twist density of the outer fiber also depends on the end-use of the yarn. For example, items such as socks may require more twists than blankets. The density of twists of the outer fiber may be from about 200 to about 500 twists per meter. Other twist densities are contemplated.

FIG. 1 illustrates an example method 100 of creating a composite yarn comprising an alpaca fiber core.

At step 102, the raw alpaca fleece is obtained and sent to a scouring mill to be cleaned. This removes organic material in an environmentally friendly manner. Such a process does not require treatment with harsh or environmentally detrimental chemicals.

Figure 2:
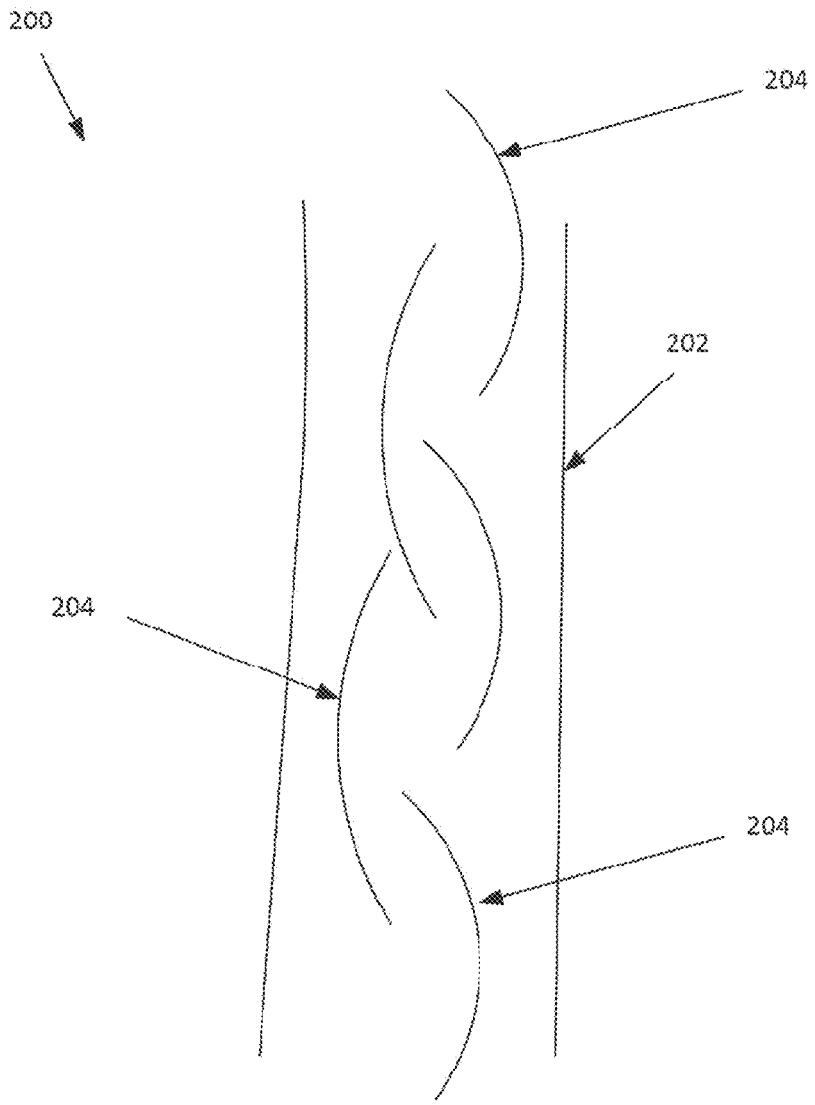
FIG. 2 illustrates a simplified alpaca fiber.

At step 104, the cleaned alpaca fleece is dried and carded. The alpaca fleece is also roved, in which all the fibers are organized to be facing a single direction. The alpaca fiber is shown in FIG. 2.

At step 106, the yarn core is created. The yarn core may be created using the plurality of different methods as described below.

In a first method, the yarn core consists of alpaca fibers. In such an embodiment, the alpaca roving is twisted and spun to create the core. No other types of fibers are twisted with the alpaca fibers in the first method.

In a second method, the yarn core includes alpaca fibers and another fiber material. In the second method, the alpaca roving is twisted, spun, and blended with the additional material to create the alpaca-comprising yarn core.

In a third method, the yarn core includes the alpaca fibers and an additional material. In the third method, the alpaca yarn is plied and/or twisted with the additional material in the opposite direction to create the core. In this example, a two- or three-ply yarn/mating is created.

At step 108, the core is wrapped with another material. In a first embodiment, the outer wrapping is a material that is different than the alpaca fiber core. In another embodiment, the outer wrapping comprises alpaca fiber and another fiber. The outer wrapping may be mated or married with the alpaca fiber core.

Depending on the end-use of the yarn, a differing number of twists of the fibers per meter are used. In an example, from about 200 to about 500 twists per meter are used to create a yarn for a standard textile. For a blanket textile, from about 100 to about 200 twists per meter are desired. Socks may require up to from about 500 to about 750 twists per meter. The more twists per meter creates a strong and more rugged yarn.

The outer wrapping may be a single type of fiber, such as a type of natural or synthetic fiber described above. In another embodiment, the outer wrapping may be a blended fiber, or a mated yarn. The blended fiber or mated yarns may include any combination of the natural or synthetic fibers described above.

In an embodiment, the outer wrapping comprises an alpaca fiber blend in the amount of approximately 80% alpaca fiber and 20% other fibers. In another embodiment, the outer wrapping comprises an alpaca fiber blend in an amount of from about 70% to about 80% and from about 30% to about 20% other fibers. In yet another embodiment, the outer wrapping comprises an alpaca fiber blend in an amount of from about 60% to about 70% and from about 40% to about 30% other fibers.

A higher ratio of alpaca fibers to other fibers creates a softer yarn, and therefore a softer textile and more breathable.

FIG. 2 illustrates a simplified alpaca fiber 200. The alpaca fiber 200 includes a plurality of fiber barbs 204 extending from the core wall 202. The core wall 202 is sturdy, and the core itself is essentially hollow. The fiber is about 20 μm in diameter. As shown, the barbs 204 curl towards the center of the fiber. The shape of the barbs 204 naturally wicks away moisture.

Figure 3:
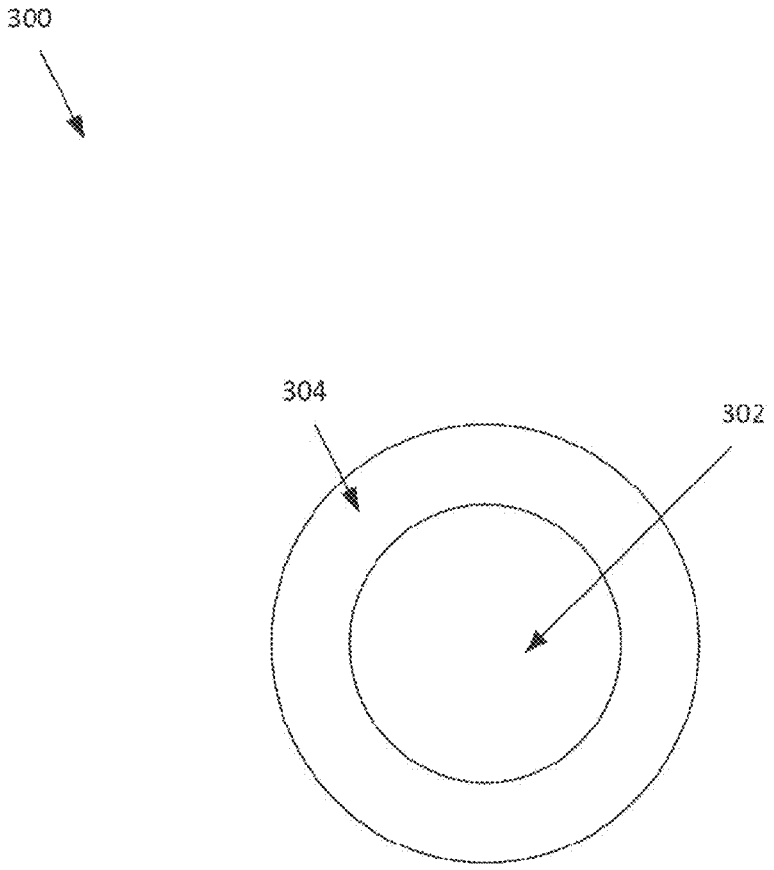
FIG. 3 illustrates a cross-sectional view of the composite yarn.

FIG. 3 illustrates a cross-sectional view of the inventive composite yarn 300. As described herein, the composite yarn 300 includes a core 302 surrounded by an outer coating 304. The composite yarn 300 described herein comprises a core 302 of at least alpaca fibers. As discussed above, the core 302 may consist of alpaca fibers and no other fiber. Alternatively, the core 302 comprises alpaca fibers blended with other types of natural or synthetic fibers.

In a first embodiment, the outer wrapping 304 comprises a single natural or synthetic fiber. The natural fiber may be alpaca fiber, or may be another type of fiber listed above. In another embodiment, the outer wrapping 304 comprises a plurality of natural or synthetic fibers. The plurality of fibers may be wrapped or mated together. Alternatively, the plurality of fibers may be laid side by side and then twisted together.

Figure 4:
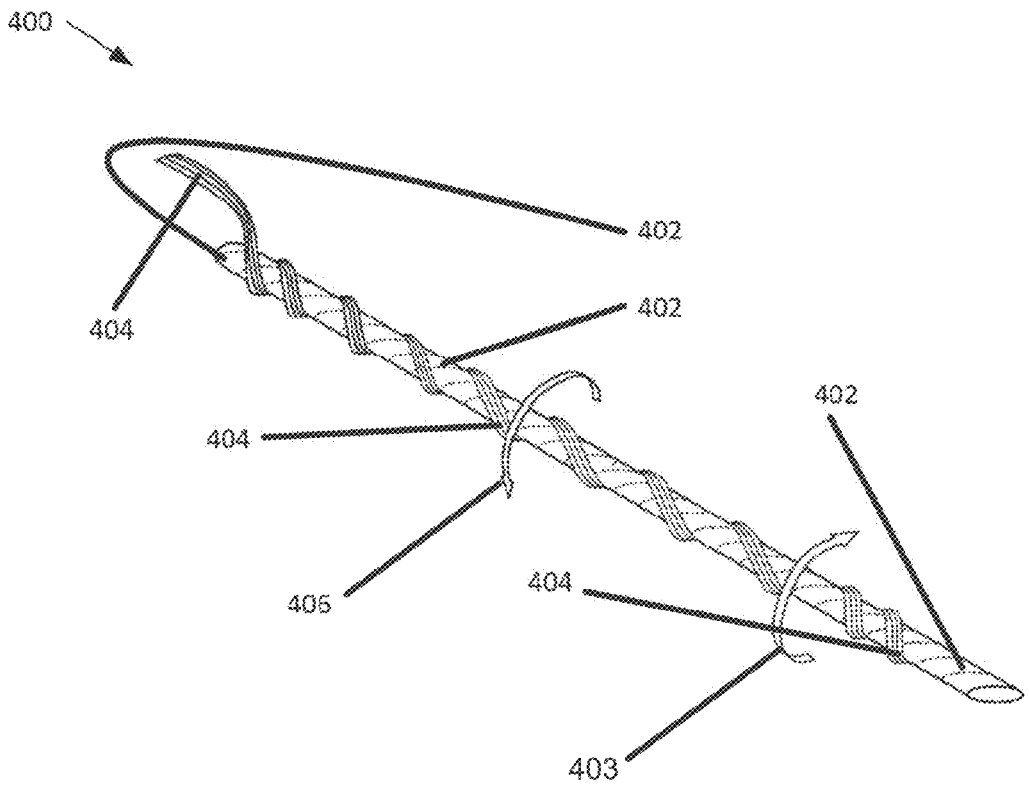
FIG. 4 illustrates an example wrapped fiber.

FIG. 4 illustrates an example wrapped fiber 400. The wrapped fiber 400 includes a core 402. In an example, the core 402 is primarily alpaca, but in other embodiments the core 402 may be blended or mated with other natural or synthetic fibers.

The wrapping 404 can occur at different rates per meter depending on the type of fabric desired. The wrapping 404 may be a synthetic or natural fiber. The wrapping 404 may be a single fiber, or a plurality of fibers, where the plurality of fibers is mated and/or blended with each other.

As shown, the wrapping 404 occurs in a single direction 406 around the core 402.

The wrapping process of making the composite yarn starts with a core 402 of alpaca yarn that is twisted 403 to a desired twist density. Then, the other fibers 404 are twisted 406 around the core to create the outer coating. The other fibers 404 may be a single type of fiber or may be a plurality of fibers wrapped or mated together.

In an embodiment, the other fibers that create the outer coating may be selected from tree bark (such as fibers commercially available under the TENCEL™ brand including Lyocell and Modal fibers), eucalyptus bark, bamboo, alpaca fibers, an alpaca fiber blend, spandex, nylon, or other similar fibers, and combinations thereof.

Advantageously, the method of creating the alpaca fiber core yarn as described herein has anti-microbial and anti-bacterial properties. The unique process of spinning and wrapping the alpaca fiber to create the composite yarn limits or eliminates bacterial growth. The method of twisting and then wrapping the fibers to create the composite yarn reduces the ability of bacteria to pool within the yarn. Twisting the yarn maximizes the surface area of the alpaca fiber.

Additionally, the method of spinning and wrapping the alpaca fibers to form the core and/or outer wrapping minimizes or eliminates bacterial odor and growth. Textiles that eliminate bacterial odor and growth are desirable for clothing, medical fabrics and devices, footwear, fabric-covering surfaces, towels, sheets, rugs, blankets, pillows, and wash rags.

The composite yarn described herein can be useful for a variety of textiles. For example, the composite yarn may be used to make clothing, footwear, upholstery, rugs, blankets, pillow covers, towels, sheets, and wash rags. Further, the composite yarn may be used to make footwear, still further, the composite yarn may be used to make medical fabrics and other medical devices comprising a fabric component.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

The invention claimed is:

1. A composite yarn comprising:

a twisted core comprising an alpaca fiber roving, wherein the alpaca fiber roving is twisted and spun to create the core having a twist density of from about 100 to about 750 twists per meter; and an outer wrapping comprising a second fiber, wherein the alpaca fiber roving of the core is wrapped with the second fiber in an opposite direction to the twist of the core.

2. The composite yarn of claim 1, wherein the core consists of alpaca fiber.

3. The composite yarn of claim 1, wherein the core further comprises a second core fiber, wherein the second core fiber is different than the alpaca fiber roving.

4. The composite yarn of claim 3, wherein the second core fiber is blended with the alpaca fiber roving and twisted together to create the core.

5. The composite yarn of claim 3, wherein the alpaca fiber roving is twisted and spun upon itself, and plied and twisted with the second core fiber.

6. The composite yarn of claim 1, wherein the second fiber is a natural fiber or a synthetic fiber.

7. The composite yarn of claim 1, wherein the yarn resists microbial growth.

8. The composite yarn of claim 1, wherein the composite yarn is not treated with chemicals or other additives.

9. The composite yarn of claim 1, wherein the core twist density is from about 100 to about 200 twists per meter, about 200 to about 500 twists per meter, or about 500 to about 750 twists per meter.

10. The composite yarn of claim 1, wherein the second fiber of the outer wrapping is a natural fiber, optionally wherein the natural fiber is selected from the group consisting of a second alpaca fiber, alpaca fiber blend, goat fiber, sheep fiber, mink fiber, beaver fiber, ermine fiber, fox fiber, nutria fiber, opossum fiber, sable fiber, seal fiber, muskrat fiber, raccoon fiber, squirrel fiber, camel fiber, llama fiber, tree bark fiber, and bamboo fiber.

11. The composite yarn of claim 1, wherein the second fiber of the outer wrapping is a synthetic fiber, wherein the synthetic fiber is a polymer, optionally wherein the polymer is selected from the group consisting of spandex and nylon.

12. A method of making a composite yarn comprising:

providing a twisted core comprising an alpaca fiber roving having a twist density of from about 100 to about 750 twists per meter, and providing an outer wrapping comprising a second fiber wrapped in an opposite direction to the twist of the core.

13. The method of claim 12, wherein the alpaca fiber roving is blended with a second core fiber, and twisted together to create the core.

14. The method of claim 12, wherein the core comprises the alpaca fiber roving and a second core fiber, and wherein the core is made by mating or marrying the alpaca fiber roving with the second core fiber.

15. The method of claim 12, wherein the composite yarn is not treated with chemicals or other additives.

16. The method of claim 12, wherein the core is twisted to a twist density of from about 100 to about 200 twists per meter, about 200 to about 500 twists per meter, or about 500 to about 750 twists per meter.

* * * * *